US006479781B1

(12) United States Patent
Bagepalli et al.

(10) Patent No.: US 6,479,781 B1
(45) Date of Patent: Nov. 12, 2002

(54) ARC CHUTE ASSEMBLY FOR CIRCUIT BREAKER MECHANISMS

(75) Inventors: Bharat Sampathkumaran Bagepalli, Niskayuna, NY (US); Aniruddha Dattatraya Gadre, Niskayuna, NY (US); Ronald Ciarcia, Bristol, CT (US); Kamlesh Mundra, Niskayuna, NY (US); Eladia Pulido, West Hartford, CT (US)

(73) Assignee: General Electric Company, Niskayuna, NY (US)

( * ) Notice: Subject to any disclaimer, the term of this patent is extended or adjusted under 35 U.S.C. 154(b) by 18 days.

(21) Appl. No.: 09/602,321

(22) Filed: Jun. 23, 2000

(51) Int. Cl.[7] ..... H01H 33/02
(52) U.S. Cl. ..... 218/156; 218/151
(58) Field of Search ..... 218/7, 15, 34, 218/35, 36, 38, 39, 46–47, 76, 149, 151, 156, 157

(56) References Cited

U.S. PATENT DOCUMENTS

| | | | | |
|---|---|---|---|---|
| 2,655,578 A | * | 10/1953 | Sillers | 218/149 |
| 2,668,890 A | * | 2/1954 | Latour | 218/151 |
| 3,009,041 A | | 11/1961 | Zlupko | |
| 3,210,504 A | * | 10/1965 | Latour | 218/156 |
| 3,440,378 A | * | 4/1969 | Baird | 218/151 |
| 4,107,497 A | | 8/1978 | Jencks et al. | |
| 4,950,852 A | * | 8/1990 | Goldman | 218/151 |
| 5,247,142 A | | 9/1993 | Yonkovitz et al. | |
| 5,818,003 A | | 10/1998 | Moldovan et al. | |
| 5,898,152 A | | 4/1999 | Kim | |

FOREIGN PATENT DOCUMENTS

| | | |
|---|---|---|
| DE | 403 068 | 9/1924 |
| FR | 2 153 749 | 4/1973 |

* cited by examiner

*Primary Examiner*—Lincoln Donovan
(74) *Attorney, Agent, or Firm*—Patrick K. Patnode; Christian G. Cabeu

(57) ABSTRACT

A current limiting circuit breaker mechanism having two pairs of separable contacts closely spaced for electrodynamic repulsion upon the occurrence of a short circuit overload condition utilizes a pair of arc chute assemblies to cool and extinguish the arc that occurs when the contacts become separated. The arc chute assemblies contain a plurality of arc chute plates supported by side supports. The arc chute plates are aerodynamically designed to facilitate the easy flow of the arc plasma gases into and out of the chute and provide minimal reflection of the arc plasma wave against the contact arm.

4 Claims, 6 Drawing Sheets

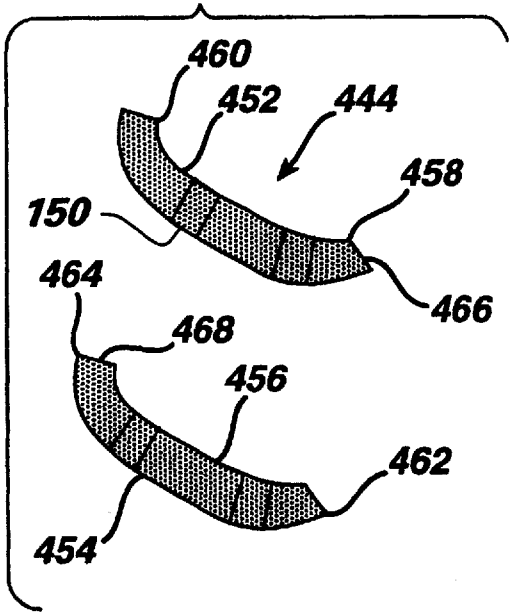
FIG. 7
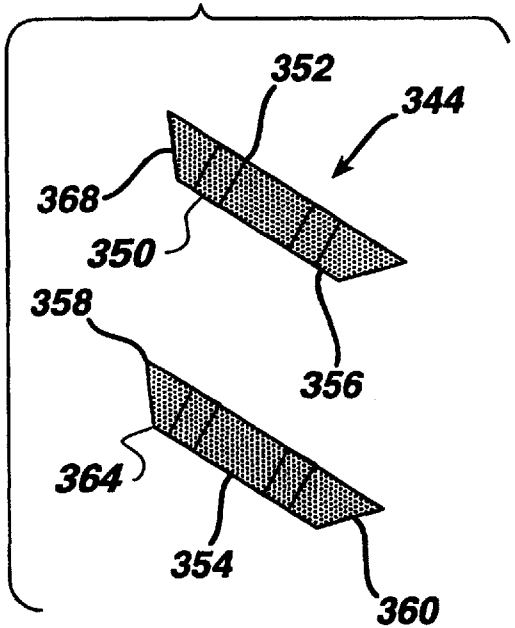
FIG. 8
FIG. 9

ARC CHUTE ASSEMBLY FOR CIRCUIT BREAKER MECHANISMS

TECHNICAL FIELD

This invention relates to circuit breaker mechanisms and, more particularly, to arc chute assemblies for circuit breaker mechanisms.

BACKGROUND OF THE INVENTION

Arc chutes or arc shields are commonly used to confine and extinguish an electric arc that is produced when the circuit breaker mechanism is tripped and the contacts are rapidly opened. A molded case circuit breaker mechanism 10 is shown in FIG. 1 comprising a case 12 with the cover removed to show the interior components depicted in an open position. The current carrying components include two fixed contacts 14, 16 and two movable contacts 18, 20 attached to an operating mechanism 22 by means of a movable contact arm 24. The operating mechanism is refrained from driving the movable contact arm and movable contact to the open position under the bias provided by a pair of powerful operating springs (not shown). The two pairs of springs provide a floating assembly of the operating mechanism 22 in an orifice 28 allowing rotation of the contact arm 24 around an axis 30. Pairs of springs also provide the contact pressure in the closed position of the pole. Pairs of springs are arranged symmetrically with respect to axis of rotation 30 of contact arm 24, so as to exert in any position of the contact arm 24, a return torque of the contact arm 24 to the closed position.

In the closed position of the contact arm 24, the fixed contact 14 cooperates with the movable contact 18 borne by the contact arm 24, whereas the fixed contact 16 cooperates with the movable contact 20. The current input at a given moment via an input conductor 32 flows through the fixed contacts 14, 16, contact arm 24, and movable contacts 18, 20, and is output on the opposite side via a conductor 34. It can be seen that the ends 36, 38 of conductors 32, 34 have flowing in them currents of opposite polarities to the currents flowing in the contact arm 24, thereby generating a repulsion force moving the contact arm 24 to the open position. This looped trajectory in the zone of the contacts 14, 16, 18, 20 generates a magnetic blowout field.

The magnetic blowout field comprises an arc plasma discharge that momentarily stays for a short while in the zone of fixed contacts 14, 16 and then moves toward arc chute assemblies 40, 42 in accordance with a sudden upward bouncing of the movable contacts 18, 20 as a sudden disconnection.

Then, as the movable contacts 18, 20 move upwards in the direction of arrow 43, the stable contacts 14, 16 become further distanced from the movable contacts 18, 20, and accordingly the arc moves toward an internal portion of arc chute assemblies 40, 42 by an electromagnetic force generated between the a plurality of arc chute plates 44 and the arc current (FIG. 2).

Referring now to FIG. 2, the plasma arc discharge that has moved inside the arc chute plates 44 are serially partitioned according to the arc chute plates aligned on every other floor therein, and the arc resistance becomes rapidly increased and accordingly the arc voltage becomes rapidly increased by related factors, such as cathode effect of the plates 44 in which when the arc comes into the arc chute assemblies 40, 42, the plates 44 are respectively turned to positive poles or negative poles, a cooling effect in which the arc is partitioned into shorter arcs between the plates 44 and extinguished in the air by cooling, and a pressure effect according to an arc energy by an increased magnetic flux density with regard to a pressure increase in the arc chute assemblies 40, 42.

Referring now to FIG. 3, the conventional arc chute assembly for extinguishing plasma arc discharge will now be described. The conventional arc chute assembly 40 includes plurality of arc chute piates 44 formed of a metal or an alloy of metals for inducing magnetism, and a plurality of sidewalls 46 formed of insulation material.

Arc chute plates 44 respectively include a plurality of engagement protrusions 48 extended from each side thereof and cut off by the respective centers thereof. The sidewalls 46 include a plurality of slots 50 for receiving corresponding ones of the engagement protrusions 48.

The combining steps between the plates 44 and the sidewalls 46 for forming the arc chute assemblies 40, 42 will now be described. The plates 44 including the engagement protrusions 48 are fixed using a gig and then the plates 44 are respectively inserted into a corresponding one of the engagement slots 50 formed in the sidewalks 46. In order for the plates 44 not to escape from the sidewalls 46, the sidewalls 46 are bound by a rubber string.

The respective cut-off portions of the engagement protrusions 48 are opened to each side thereof by employing a riveting process, thereby fixing the plates 44 to the sidewalls 46.

Likewise, plurality of plates 44 are stacked with a space therebetween between the sidewalls 46, and the assembled arc chute assembly 40 is mounted in the arc extinguishing chamber provided in the circuit breaker. However, the conventional arc chute assembly 40 allows the plates 44 to be inserted into the sidewalls 46, and in order for the plates 44 not to be released from the sidewalls 46, the sidewalls 46 are fixed by use of a rubber string and there is further followed a riveting process for the fixture.

Referring again to FIG. 2, the present arc chute design depicts how hot arc plasma gas generated by the opening operation between the stationary and movable contacts flows through a set of iron arc plates in the direction of arrows 52.

As a result, there is a need for an arc chute designed to prevent discharged arc plasma gas from collecting on the contact arm.

There is also a need for an arc chute designed to promote the flow of discharged arc plasma gas through the spaces between a set of arc plates.

There is also a need for an arc chute plate design that minimizes the drag/reflecting areas at the edges of the arc chute plates.

There is also a need for an arc chute plate design having aerodynamically cut edges to facilitate the easy flow of arc plasma gas into the chute, and out of it.

There is also a need for an arc chute plate design having aerodynamically cut edges to facilitate minimal reflection of the arc plasma wave.

BRIEF SUMMARY OF THE INVENTION

The exemplary embodiments include an arc chute assembly for a circuit breaker mechanism having a pair of support members and a plurality of plates being supported by the pair of support members. The assembly has a plurality of plates that define a plurality of openings where the support members are positioned so as to define the plurality of openings. The plates each have a pair of tabs which are received in a corresponding pair of openings within each of the support members. The plates are configured to have at least one aerodynamic feature to facilitate the movement and extinguishing of discharged arc plasma waves and the plates are configured to have an opening along the periphery of one of the sides of said plates. The openings are configured to facilitate the movement and extinguishing of discharged arc plasma waves.

These and other features and advantages of the present invention will be apparent from the following brief description of the drawings, detailed description, and appended claims and drawings.

BRIEF DESCRIPTION OF THE DRAWINGS

The invention will be further described in connection with the accompanying drawings, which are meant to be exemplary, not limiting, and wherein:

FIG. 7 depicts an alternative exemplary embodiment of an arc chute plate of the arc chute assembly of FIG. 4;

FIG. 8 depicts another alternative exemplary embodiment of an arc chute plate of the arc chute assembly of FIG. 4; and FIG. 9 depicts yet another alternative exemplary embodiment of an arc chute plate of the arc chute of FIG. 4.

DETAILED DESCRIPTION OF THE PRESENT INVENTION

Figure 4:
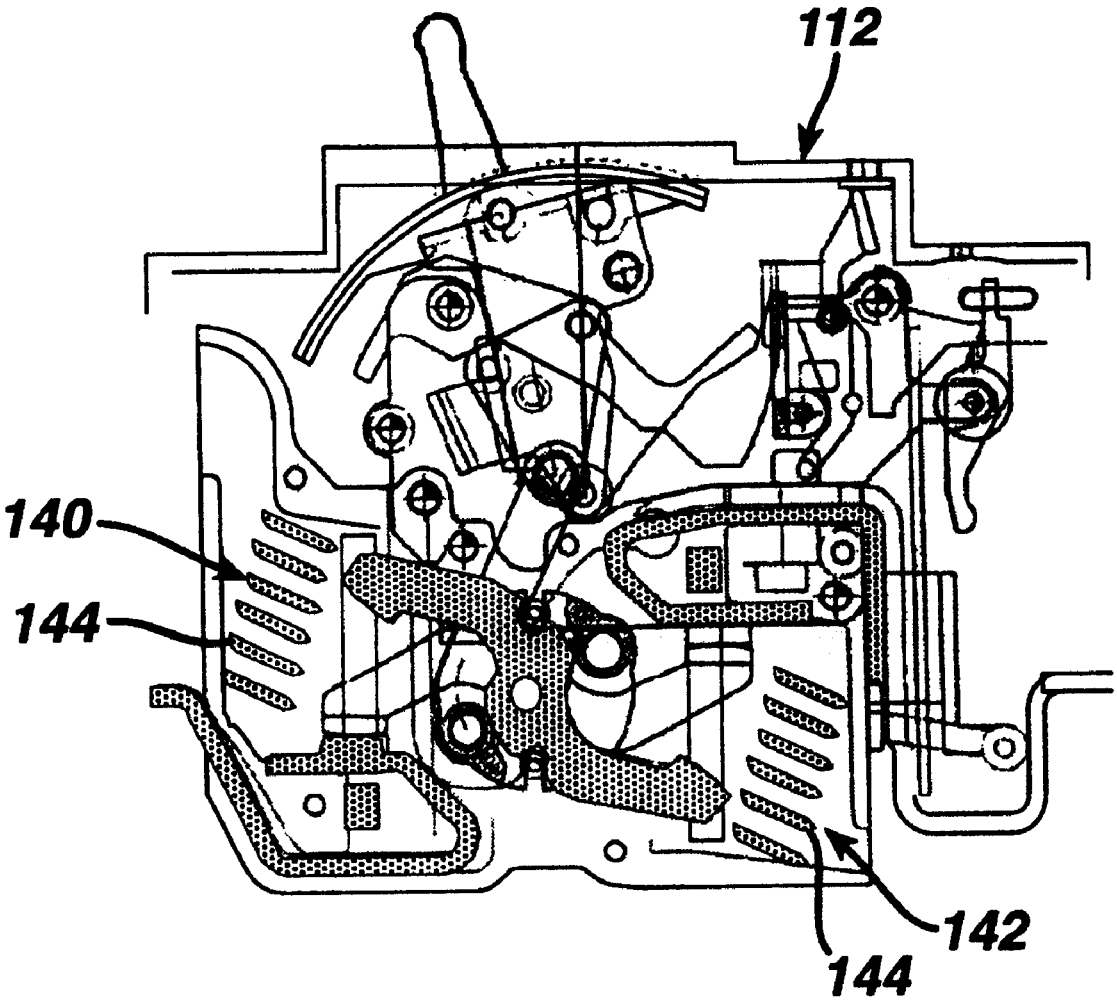
FIG. 4 depicts an exemplary embodiment of an arc chute assembly of the present invention within a circuit breaker.

As shown in FIG. 4, two arc chute assemblies 140, 142 are depicted in a case 112 with the cover removed to show the interior components depicted in an open position. Arc chute assemblies 140, 142 contain a plurality of spaced arc chute plates 144 supported by a pair of side supports 146, which have been removed to show the contours of the arc chute plates 144.

Figure 5:
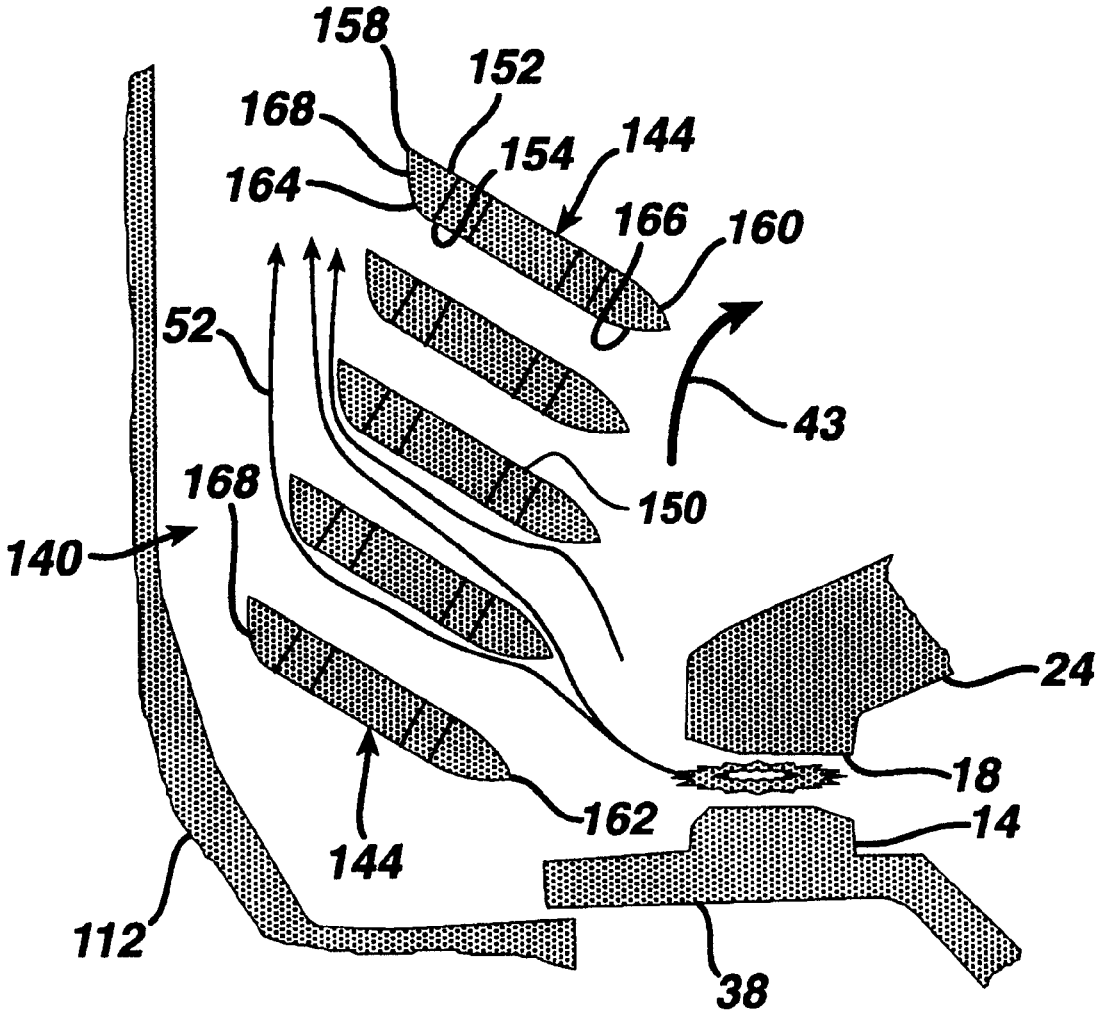
FIG. 5 depicts an enlarged view of area 5—5 in FIG. 4 of the exemplary arc chute assembly of the present invention.
Figure 6:
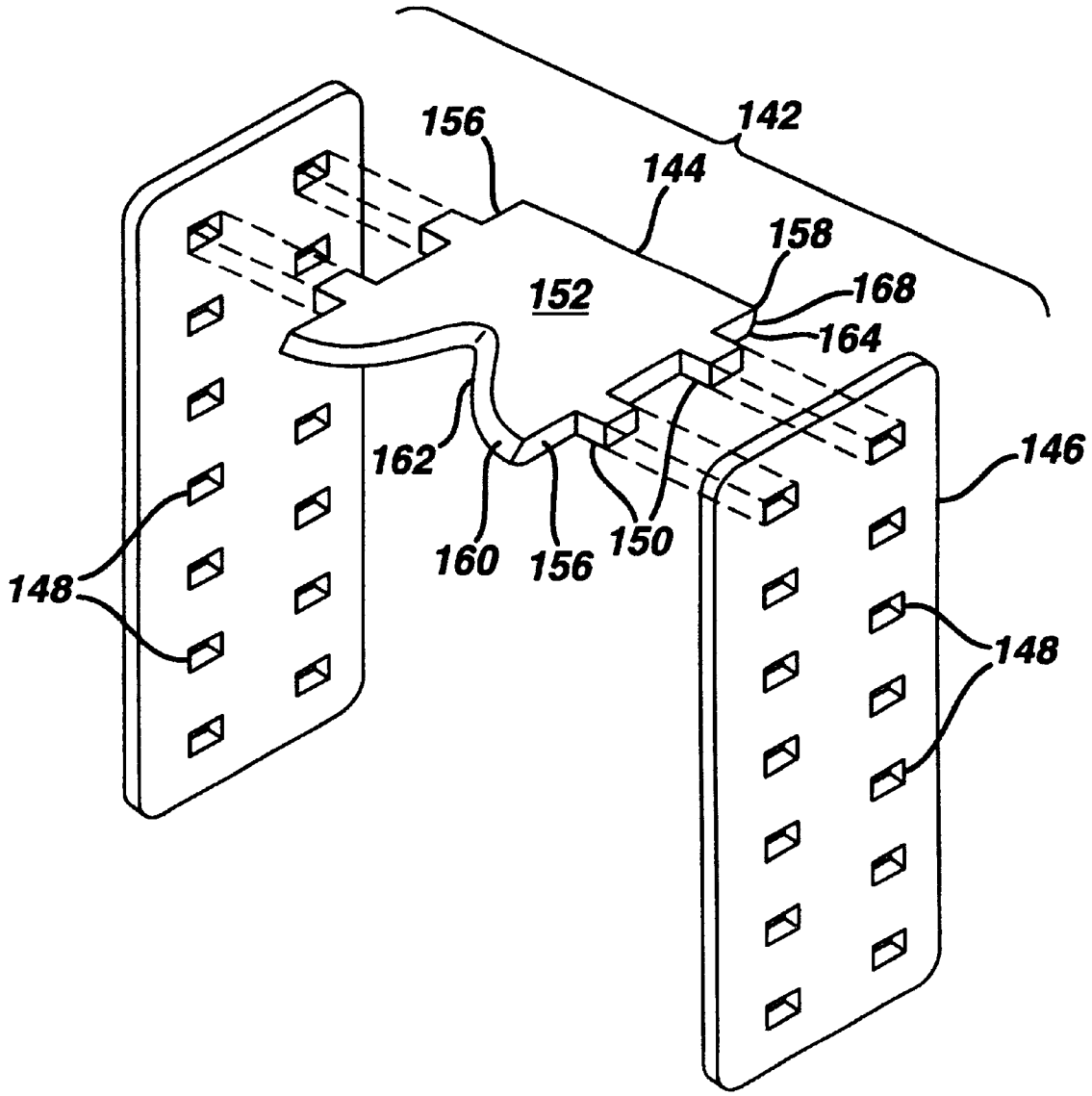
FIG. 6 is an enlarged front perspective view of the arc chute assembly of FIG. 4 with the side supports in isometric projection from an exemplary arc plate.

The configuration of the arc chute plates 144 is best seen in FIGS. 5 and 6. Arc chute side supports 146 contain a plurality of receiving openings 148 that can be punched or formed for receiving a corresponding plurality of support inserts 150 that extend from both sides of plurality of arc chute plates 144. In operation, the discharged plasma arc is electrodynamically driven within the arc plates 144 wherein the arc is cooled and quenched as rapidly as possible. To assist in the arc quenching process, arc chute side supports 146 include a gas evolving resin material that becomes heated and evolves a substantial quantity of disassociated gaseous material. The disassociated gaseous material immediately becomes expelled through the respective arc chute assemblies 140, 142.

To insure that the arc chute side supports 146 are capable of sustaining both the high voltage gradient developed across the arc chute plates 144 and the high temperatures associated with the arc, the arc chute side supports are preferably fabricated from melamine resin to which wollastonite fibers have preferably been added as a filler. The wollastonite fibers can mainly comprise fibrous calcium silicate having the general formula $CaSiO_3$. The melamine resin can be made by condensing formaldehyde with melamine; the melamine can comprise the general formula $C_3H_6N_6$. The melamine resin combines in such a manner as to readily evolve ion-neutralizing gaseous materials upon reaching elevated temperatures. The arc chute side supports 146 can be composed of other high temperature-resistant materials. Likewise, additional fillers, besides wollastonite fibers can also be added to the high temperature-resistant material. Arc chutes side supports 146 can preferably resist temperatures in conventional circuit breaker mechanism design.

Figure 1:
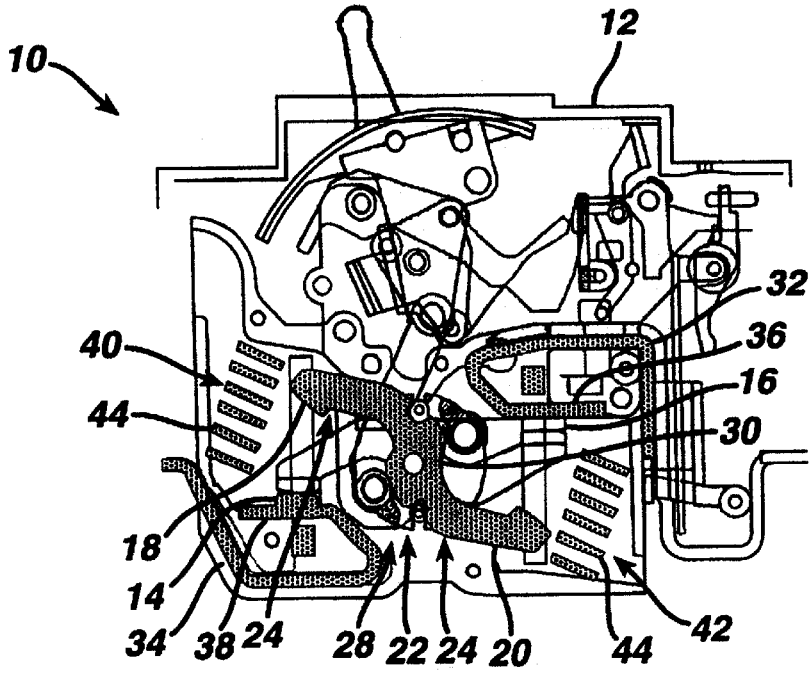
FIG. 1 Prior Art
FIG. 1 depicts a cross-sectional view of a general layout of an arc chute assembly within a circuit breaker.
Figure 2:
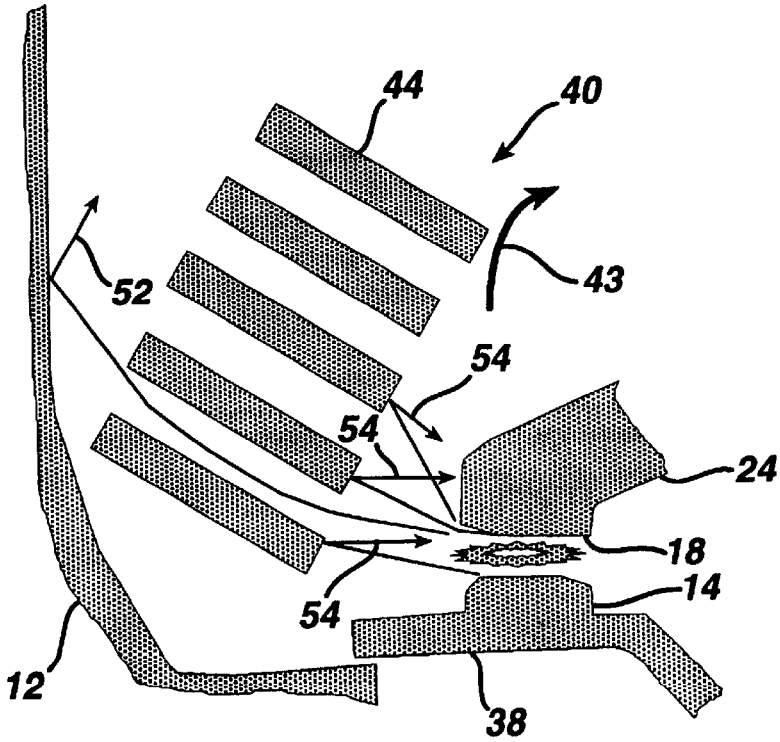
FIG. 2 Prior Art
FIG. 2 is an enlarged view of area 2—2 in FIG. 1 of an arc chute assembly of FIG. 1.
Figure 3:
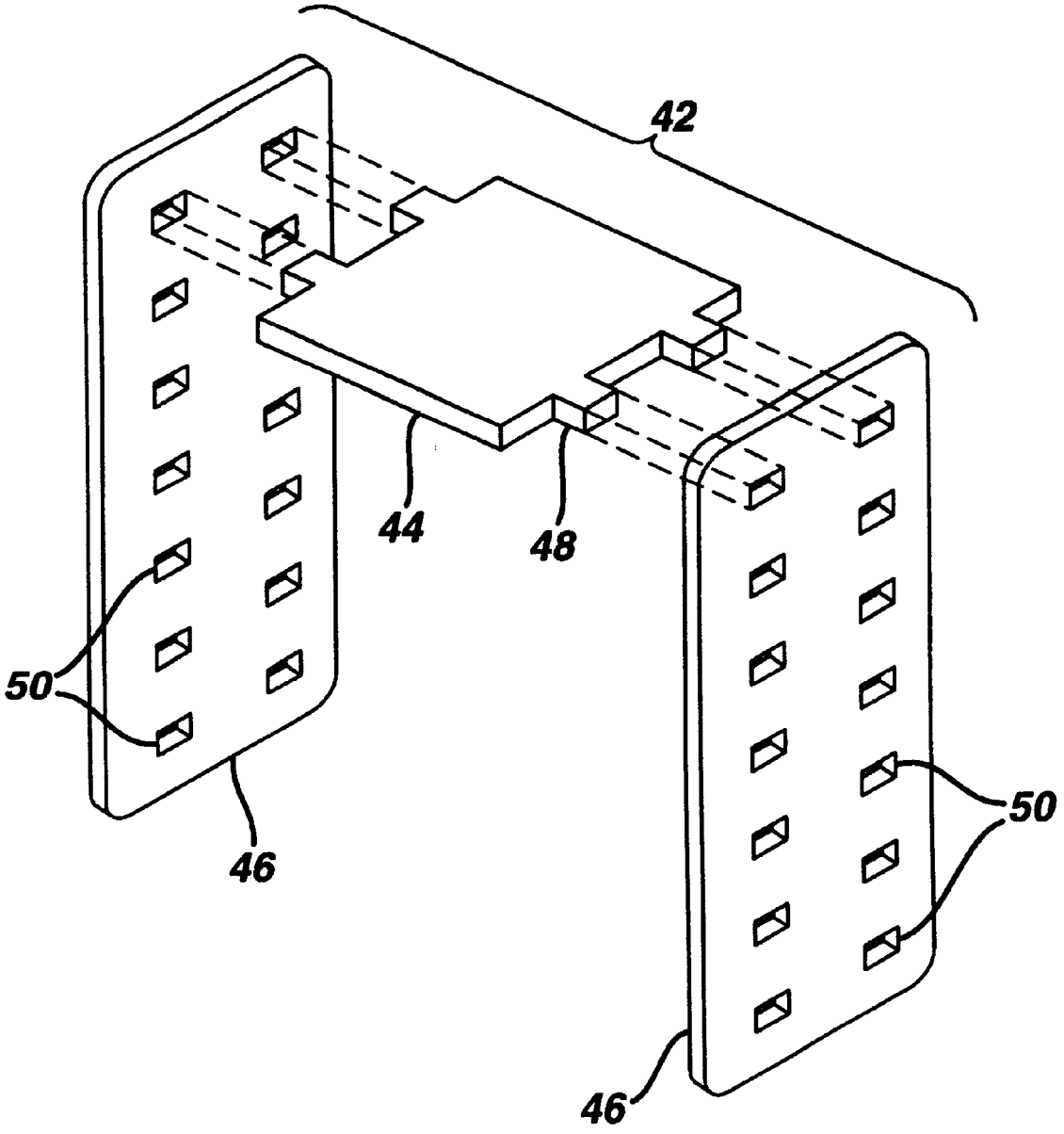
FIG. 3 Prior Art
FIG. 3 is an enlarged front perspective view of the arc chute assembly of FIG. 1 with the side supports in isometric projection from an arc plate.

The forward and rear surfaces of the arc chute plates 44 formed corners using right (90°) angles so that the arc chute plates 44 were rectangular shaped or were at least defined by flat forward and rear surfaces (See FIG. 2).

Referring back to FIG. 2, the arc plasma waves reflect off of the forward edge of the arc plates in the direction of arrows 54 as well as flow through the spaces between the arc plates. The reflected waves of discharged arc plasma gas are then cooled and extinguished by the contact arm. The reflected waves deposit chute material onto the surface of the contact arm. After the opening operation between the contacts occurs numerous times, a film of arc chute material forms on the arm contact and hinders its interaction with fixed contacts 14, 16. Consequently, the circuit breaker mechanism could no longer function properly.

The arc chutes plates 144 shown in FIGS. 5 and 6 are aerodynamically designed to improve the movement of discharged arc plasma gas through the arc chute assemblies 140, 142. An arc chute plate 144 can include a top planar surface 152, a bottom planar surface 154, and a pair of sides 156. Top planar surface 152 can be defined by a first back edge 158 and pair of sides 156. A sloping forward face 160 can be disposed downwardly from top planar surface 152. Forward face 160 slopes downwardly until reaching a forward edge 162. Bottom planar surface 154 can be defined by a second back edge 164 and pair of sides 156. A second sloping forward face 166 can be disposed upwardly from bottom planar surface 154. Forward face 166 slopes upwardly until reaching forward edge 162. A downwardly slanted rear surface 168 can be defined by first back edge 158, second back edge 164 and pair of sides 156. Plurality of support inserts 150 can extend laterally outward from and be defined by top planar surface 152, bottom planar surface 154, and pair of sides 156.

Generally, arc chute plate 144 can comprise a conventional geometry having a shape such as triangular, rectangular, pentagonal, hexagonal, and the like, to facilitate the flow of discharged arc plasma gas. More specifically, arc chute plate 144 can preferably include a geometry as depicted in FIG. 6 where forward edge 162 includes, but not limited to, a bell curvature as shown, or also a curved indentation that facilitates the flow of discharged plasma arc gas through arc chute assemblies 140, 142. Sloping forward face 160 includes the curved indentation as well as the sloping characteristic. Additionally, second sloping forward face 166 also includes the curved indentation as well as the sloping characteristic.

Downwardly sloping forward face 160, upwardly sloping forward face 166, and downwardly slanted rear surface 168 can preferably be formed by grinding the original forward and rear surfaces. More specifically, a variety of conventional grinding methods can be implemented to form the aerodynamic forward and rear surfaces of arc chute plates 144. Once the grinding process is completed, arc chute plate 144 can preferably include a slight convex curvature where forward face 160 is disposed from top planar surface 152 (See FIG. 5). A slight convex curvature is also preferably formed where forward face 166 is disposed from bottom planar surface 154 (See FIG. 5). Likewise, a slight convex curvature is preferably formed where bottom planar surface 154 physically transitions to form second back edge 164 (See FIG. 5). The convex curvatures can now allow discharged arc plasma waves to flow smoothly above and/or below the arc chute plate without resistance. The arc plasma waves are then less likely to deflect off of the forward edge or face of the arc chute plate or even the lower back edge formed by the bottom and rear surfaces.

FIG. 7 depicts an alternative embodiment of the exemplary arc chute plate. Arc chute plate 244 can include a top planar surface 252, a bottom planar surface 254, and a pair of sides 256. Top planar surface 252 can be defined by a first back edge 258 and pair of sides 256. A slanted forward face 260 can be disposed downwardly from top planar surface 252. Forward face 260 slants downwardly until reaching a forward edge 262. Bottom planar surface 254 can be defined by a second back edge 264 and pair of sides 256. A second slanted forward face 266 can be disposed upwardly from bottom planar surface 254. Forward face 266 slants upwardly until reaching forward edge 262. A downwardly slanted rear surface 268 can be defined by first back edge 258, second back edge 264 and pair of sides 256. Plurality of support inserts 150 can extend laterally outward from and be defined by top planar surface 252, bottom planar surface 254, and pair of sides 256.

Downwardly slanted forward face 260, upwardly slanted forward face 266, and downwardly slanted rear surface 268 can preferably be formed by cutting the original forward and rear surfaces of the arc chute plate. More specifically, a variety of conventional cutting methods can be employed to form the aerodynamic forward and rear surfaces of arc chute plates 244. Once the cutting process is completed, the arc chute plate 244 preferably forms a slanted rear surface 268 as well as both slanted forward faces 260, 266. The slanted angles of these surfaces also provide the discharged plasma arc waves a smoother flow path above and/or below the arc chute plates 244.

FIG. 8 depicts a second alternative embodiment of the exemplary arc chute plate. Arc chute plate 344 can include a top planar surface 352, a bottom planar surface 354, and a pair of sides 356. Top planar surface 352 can be defined by a first back edge 358 and pair of sides 356. A slanted forward face 360 can be disposed downwardly from top planar surface 352. Forward face 360 slants downward until reaching bottom planar surface 354. A downwardly slanted rear surface 368 can be defined by first back edge 358, second back edge 364 and pair of sides 356. Plurality of support inserts 350 can extend laterally outward from and be defined by top planar surface 352, bottom planar surface 354, and pair of sides 356.

Slanted forward face 360 and slanted rear surface 368 can preferably be formed by cutting the original forward and rear surfaces of the arc chute plate. More specifically, a variety of cutting methods can be utilized to form the aerodynamic forward and rear surfaces of arc chute plates 344. Once the cutting process is completed, the arc chute plate 344 preferably forms slanted forward face 360 and slanted rear surfaces 368. The slanted angles of these surfaces also provide the discharged plasma arc waves a smoother flow path above and/or below the arc chute plates 344.

FIG. 9 depicts a third alternative embodiment of the exemplary arc chute plate. Arc chute plate 444 can include a substantially concave top surface 452, a substantially convex bottom surface 454, and a pair of sides 456. Top surface 452 can be defined by a first front edge 458 and a first back edge 460. Bottom surface 454 can be defined by a second front edge 462 and a second back edge 464. A slanted front surface 466 can be angularly disposed between first front edge 458 and second front edge 462. A slanted rear surface 468 can be angularly disposed between first back edge 460 and second back edge 464. Plurality of support inserts 150 can extend laterally outward from and be defined by top surface 452, bottom surface 454, and pair of sides 456.

Substantially concave top surface 452 and substantially convex bottom surface 454 can preferably be formed by stamping the original piece of stock material comprising arc chute plate 444. More specifically, a variety of stamping methods can be employed to form the aerodynamic top and bottom surfaces of arc chute plates 444 from the stock material. Once the stock material is stamped, the arc chute plate 444 preferably forms both substantially concave top surface 452 and substantially convex bottom surface 454. The curvature of the bottom surface provides the discharged plasma arc waves a smoother flow path above and/or below the arc chute plates 444.

The improved arc chute plates provide many advantages over current arc chute plates in arc chute assemblies for circuit breaker mechanisms. First, the arc chute assemblies are constructed with improved arc chute plates having a unique aerodynamic design for preventing discharged arc plasma gas from collecting on the contact arm. Second, the aerodynamic design of the improved arc chute plates prevents discharged plasma arc waves from deflecting off of the front of the arc chute plates. The discharged plasma arc waves flow above and/or below each plate and through the set of plates of the assemblies. This prevents the plasma arc waves from cooling on the contact arm and depositing residue. Third, the improved arc chute plates incorporate several embodiments, each which minimizes the drag/reflecting areas at the edges of the arc chute plates to prevent reflecting discharged plasma arc waves back towards the contact arm. Fourth, preventing a residue build up on the contact arm will prolong the life of the circuit breaker mechanism and improve its overall efficiency and durability.

While the invention has been described with reference to a preferred embodiment, it will be understood by those skilled in the art that various changes may be made and equivalence may be substituted for elements thereof without departing from the scope of the invention. In addition, many modifications may be made to adapt a particular situation or material to the teachings of the invention without departing from the essential scope thereof. Therefore, it is intended that the invention may not be limited to the particular embodiment disclosed as the best mode contemplated for carrying out this invention, but that the invention will include all embodiments falling within the scope of the appended claims.

What is claimed is:

1. An arc chute assembly for a circuit breaker comprising:

a pair of side supports; and a plurality of plates in a spaced apart stacked relationship, each of said plates comprising a top planar surface, a bottom planar surface, a pair of sides, a sloping forward face, a second sloping forward face, a forward edge, a downwardly slanted rear surface, and a plurality of support inserts extending from opposing sides of said plate, said top planar surface comprising a first back edge and said bottom planar surface comprising a second back edge, said sloping forward face sloping from said top planar surface towards said bottom planar surface to intersect said top planar surface at an edge opposite said first back edge, said second sloping forward face sloping from said bottom planar surface towards said top planar surface to intersect said bottom planar surface at an edge opposite said second back edge, said sloping forward face and said second sloping forward face intersecting to form said forward edge, said first back edge, said second back edge, and said pair of sides defining said downwardly slanted rear surface, said second back edge being disposed closer to said forward edge than said first back edge, said downwardly slanted rear surface sloping from said first back edge to said second back edge, said support inserts being disposed within said side supports.

2. An arc chute assembly for a circuit breaker comprising:

a pair of side supports; and a plurality of plates in a spaced apart stacked relationship, each of said plates comprising a top planar surface, a bottom planar surface, a pair of sides, a slanted forward face, a second slanted forward face, a forward edge, a downwardly slanted rear surface, and a plurality of support inserts extending from opposing sides of said plate, said top planar surface comprising a first back edge and said bottom planar surface comprising a second back edge, said slanted forward face slanting from said top planar surface towards said bottom planar surface to intersect said top planar surface at an edge opposite said first back edge, said second slanted forward face slanting from said bottom planar surface towards said top planar surface to intersect said bottom planar surface at an edge opposite said second back edge, said slanted forward face and said second slanted forward face intersecting to form said forward edge, said first back edge, said second back edge, and said pair of sides defining said downwardly slanted rear surface, said second back edge being disposed closer to said forward edge than said first back edge, said downwardly slanted rear surface sloping from said first back edge to said second back edge, said support inserts being disposed within said side supports.

3. An arc chute assembly for a circuit breaker comprising:

a pair of side supports; and a plurality of plates in a spaced apart stacked relationship, each of said plates comprising a top planar surfaces a bottom planar surface, a pair of sides, a slanted forward face, a downwardly slanted rear surface, and a plurality of support inserts extending from opposing sides of said plate, said top planar surface comprising a first back edge and said bottom planar surface comprising a second back edge, said bottom planar surface being shorter than said top planar surface in a direction of an arc plasma gas flow;

said slanted forward face slanting from said top planar surface towards said bottom planar surface to intersect said top planar surface at an edge opposite said first back edge, said slanted forward face intersecting said bottom planar surface at an edge opposite said second back edge, said first back edge, said second back edge, and said pair of sides defining said downwardly slanted rear surface, said second back edge being disposed closer to said slanted forward face than said first back edge, said downwardly slanted rear surface sloping from said first back edge to said second back edge, said support inserts being disposed within said side supports.

4. An arc chute assembly for a circuit breaker comprising:

a pair of side supports; and a plurality of plates in a spaced apart stacked relationship, each of said plates comprising a substantially concave top surface, a substantially convex bottom surface, a pair of sides, a slanted front surface, a slanted rear surface, and a plurality of support inserts extending from opposing sides of said plate, said substantially concave top surface comprising a first front edge and a first back edge, said substantially convex bottom surface comprising a second front edge and a second back edge, said second front edge being disposed to make first contact with an arc plasma gas flow, said first back edge being disposed closer to said second front edge than said second back edge, said first front edges said second front edge, and said pair of sides defining said slanted front surface, said first back edge, said second back edge, and said pair of sides defining said slanted rear surface, said slanted front surface slanting angularly from said first front edge towards said second front edge, said slanted rear surface slanting angularly from said first back edge towards said second back edge, said support inserts being disposed within said side supports.

* * * * *